US008647471B2

(12) United States Patent
Sommer et al.

(10) Patent No.: US 8,647,471 B2
(45) Date of Patent: Feb. 11, 2014

(54) PROCESS FOR THE PRODUCTION OF SIZED AND/OR WET-STRENGTH PAPERS, PAPERBOARDS AND CARDBOARDS

(75) Inventors: Stefan Sommer, Leverkusen (DE); Erhard Luehmann, Bomlitz (DE); Serkan Unal, Pittsburgh, PA (US); Micheal J. Dvorchak, Monroeville, PA (US)

(73) Assignees: Bayer MaterialScience LLC, Pittsburgh, PA (US); Bayer MaterialScience AG, Leverkusen (DE)

( * ) Notice: Subject to any disclaimer, the term of this patent is extended or adjusted under 35 U.S.C. 154(b) by 0 days.

(21) Appl. No.: 12/975,470

(22) Filed: Dec. 22, 2010

(65) Prior Publication Data

US 2012/0160437 A1 Jun. 28, 2012

(51) Int. Cl.
*D21H 17/57* (2006.01)
*D21H 25/04* (2006.01)

(52) U.S. Cl.
USPC ..... 162/164.6; 162/168.2; 162/192; 162/204; 428/160

(58) Field of Classification Search
USPC ..... 162/158, 164.1, 164.6, 169, 192, 162/204–207; 522/90, 92, 97–98; 524/198; 252/182.22, 600; 516/62; 428/34.2, 428/158–168, 195.1
See application file for complete search history.

(56) References Cited

U.S. PATENT DOCUMENTS

| | | | | |
|---|---|---|---|---|
| 3,971,764 | A | 7/1976 | Schurmann et al. | |
| 4,065,608 | A * | 12/1977 | Beck et al. | 525/380 |
| 4,372,814 | A * | 2/1983 | Johnstone et al. | 162/124 |
| 4,617,341 | A | 10/1986 | Laine et al. | |
| 4,892,620 | A * | 1/1990 | Beuzelin et al. | 162/158 |
| 5,397,436 | A * | 3/1995 | Robeson et al. | 162/158 |
| 5,660,919 | A * | 8/1997 | Vallee et al. | 428/206 |
| 5,684,081 | A | 11/1997 | Dannhorn et al. | |
| 5,718,804 | A | 2/1998 | Jansen et al. | |
| 5,767,220 | A * | 6/1998 | Venham et al. | 528/49 |
| 6,100,326 | A | 8/2000 | Richter et al. | |
| 6,310,132 | B1 * | 10/2001 | Sackmann et al. | 524/457 |
| 6,521,702 | B1 | 2/2003 | Weikard et al. | |
| 6,946,049 | B2 * | 9/2005 | Yamaguchi | 156/291 |
| 7,268,172 | B2 * | 9/2007 | Bach et al. | 522/92 |
| 7,323,084 | B2 * | 1/2008 | Turri et al. | 162/158 |
| 7,452,525 | B1 * | 11/2008 | Berezkin et al. | 424/59 |
| 7,534,323 | B2 * | 5/2009 | Iengo et al. | 162/164.1 |
| 7,687,554 | B2 * | 3/2010 | Schellenberg et al. | 523/223 |
| 7,868,055 | B2 * | 1/2011 | Blum et al. | 522/84 |
| 8,034,322 | B2 * | 10/2011 | Berezkin et al. | 424/59 |
| 8,114,938 | B2 * | 2/2012 | Berezkin et al. | 524/591 |
| 2003/0150576 | A1 * | 8/2003 | Yamaguchi | 162/192 |
| 2005/0000668 | A1 * | 1/2005 | Iengo et al. | 162/164.1 |
| 2005/0267230 | A1 * | 12/2005 | Esaki et al. | 522/172 |
| 2006/0231223 | A1 | 10/2006 | Ward et al. | |
| 2006/0287416 | A1 * | 12/2006 | Schellenberg et al. | 524/100 |
| 2008/0017338 | A1 * | 1/2008 | Nordin et al. | 162/103 |
| 2008/0145563 | A1 | 6/2008 | Heischkel et al. | |
| 2008/0194775 | A1 * | 8/2008 | Blum et al. | 525/452 |
| 2008/0226569 | A1 * | 9/2008 | Berezkin et al. | 424/59 |
| 2009/0022678 | A1 * | 1/2009 | Berezkin et al. | 424/59 |
| 2009/0041689 | A1 * | 2/2009 | Berezkin et al. | 424/59 |
| 2010/0210757 | A1 * | 8/2010 | Sommer et al. | 523/402 |
| 2011/0059262 | A1 * | 3/2011 | Lockhart et al. | 427/508 |
| 2012/0041145 | A1 * | 2/2012 | Sommer et al. | 524/839 |

FOREIGN PATENT DOCUMENTS

| | | | | |
|---|---|---|---|---|
| DE | 3316592 | A1 | 11/1984 | |
| DE | 4040290 | A1 | 7/1992 | |
| DE | 19710616 | A1 | 9/1998 | |
| DE | 10226932 | A1 * | 12/2003 | C09D 175/14 |
| DE | 10226933 | A1 * | 12/2003 | C08J 5/08 |
| DE | 102008000478 | A1 | 9/2008 | |
| EP | 165150 | A1 * | 12/1985 | D21H 3/48 |
| EP | 1142947 | A1 * | 10/2001 | C08K 5/101 |
| EP | 1970391 | A2 * | 9/2008 | A61K 8/87 |
| JP | 2008231424 | A * | 10/2008 | |
| WO | 9754395 | | 12/1997 | |
| WO | WO 9805696 | A1 * | 2/1998 | C08G 18/08 |
| WO | 2012084846 | A2 * | 6/2012 | |

OTHER PUBLICATIONS

A. Pingel Keuth, Chem. Unserer Zeit. 2005. 39, p. 402-409.
J. Blechschmidt, Taschenbuch der Papiertechnik, Carl Hanser Verlag, Munich, 2010, p. 228 et. seq. and p. 300.
R. Schuhmacher, Stand und Perspektiven des Einsatzes von Leimungsmittein in der Papier-, Karton- und Papierindustrie, in: Leimen, Füllen und Färben von Papier und Karton, Papiertechnische Akademie, 1999, editors: H.G. Völkel, F. Bräuning.
Oldring, P.K.T. (ed.) in Chemistry & Technology of UV & EB Formulations For Coatings, Inks & Paints, vol. 2, 1991, SITA Technology, London, pp. 123-135.
Oldring, P. K. T. Oldring (ed.), Chemistry & Technology of UV & EB Formulations For Coatings, Inks & Paints, vol. 2, 1991, SITA Technology, London, pp. 37-56.
Oldring, P. K. T. (editor), Chemistry & Technology of UV & EB Formulations for Coatings, Inks & Paints, vol. II, chapter III: Reactive Diluents for UV & EB Curable Formulations, Wiley and SITA TEchnology, London 1997.
Methoden der Organischen Chemie, Houben-Weyl, 4th edition, vol. E20/part 2 on p. 1659. Georg Thieme Verlag, Stuttgart, 1987.

* cited by examiner

*Primary Examiner* — Jose Fortuna
(74) *Attorney, Agent, or Firm* — Donald R. Palladino; Robert S. Klemz

(57) ABSTRACT

The present invention relates to a process for the production of sized and/or wet-strength papers, paperboards or cardboards, wherein an aqueous radiation-curable dispersion containing water and at least one polymer, characterized in that the polymer contains cationic groups, is mixed with suspended wood pulp and/or chemical pulp and this mixture is sieved, pressed, thermally dried and then radiation-cured, characterized in that the dispersion is employed in amounts, based on its non-aqueous content in relation to the solid content of the wood pulp and/or chemical pulp, of from 0.001 to 10 wt. %, the papers, paperboards and cardboards produced by this process, and compositions comprising suspended wood pulp and/or chemical pulp and an aqueous radiation-curable dispersion containing at least one polymer, characterized in that the polymer contains cationic groups.

11 Claims, 2 Drawing Sheets

PROCESS FOR THE PRODUCTION OF SIZED AND/OR WET-STRENGTH PAPERS, PAPERBOARDS AND CARDBOARDS

BACKGROUND OF THE INVENTION

The present invention relates to a process for the production of sized and/or wet-strength papers, paperboards and cardboards by means of aqueous radiation-curable dispersions containing at least one polymer, characterized in that cationic groups are present, the papers, paperboards and cardboards obtainable therewith, and compositions comprising suspended wood pulp, chemical pulp and/or cellulose, and aqueous radiation-curable polymer dispersions containing cationic groups.

The terms "paper, paperboard and cardboard" used herein include sheet-like pulps and formed products which are produced from fibrous cellulose materials which are derived both from natural and from synthetic sources. Sheet-like pulps and formed products which are produced from combinations of cellulosic and non-cellulosic materials which originate from synthetic substances, such as e.g. polyamide, polyester or polyacrylic resin fibres, and from mineral fibres, such as asbestos or glass, are also included.

In the processes for the production of paper, paperboard and cardboard, resin sizes, alkyl ketene dimers (AKD) or alkylated succinic anhydride (ASA) are employed as standard as pulp sizing agents (an overview is to be found inter alia in A. Pingel Keuth, Chem. Unserer Zeit, 2005, 39, p. 402-409; J. Blechschmidt, Taschenbuch der Papiertechnik, Carl Hanser Verlag, Munich, 2010, p. 228 et seq. and p. 300; R. Schumacher, Stand und Perspektiven des Einsatzes von Leimungsmitteln in der Papier-, Karton-und Papierindustrie, in: Leimen, Füllen und Färben von Papier und Karton, Papiertechnische Akademie, 1999, editors: H. G. Völkel, F. Bräuning).

Resin sizes are based on modified tree resins in combination with aluminium salts, which are suspended with the stock shortly before the headbox. Disadvantages of the use of resin sizes is the difficulty of controlling the sizing, since this takes place in an optimum manner only at a pH of 4.7, and the associated high paper waste, the low flexibility with respect to further paper additives and the low stability of the papers because of the sizing at an acid pH.

Sizing is predominantly carried out with alkyl ketene dimers (AKD) or alkylated succinic anhydride (ASA). AKD and ASA are hydrophobic chemicals which are converted into an aqueous dispersion with the aid of protective colloids, such as e.g. cationic starch or polyvinylamine (see also DE-A 1 19710616). Sizing via AKD and ASA is carried out at a neutral pH, which must be controlled exactly, in order to achieve optimum sizing (US-A 2006/0231223 [0026]). A disadvantage of the use of AKD and ASA in the production of paper, paperboard and cardboard is the limited storage stability of the AKD and ASA dispersions, since ASA and AKD are reactive substances, AKD in particular being readily hydrolysed (AKD dispersions are storage-stable for approx. 30 days under controlled conditions). Furthermore, the dispersions are highly viscous and the solids content is only 20 wt. %, so that the logistics and use are involved and cost-intensive.

Wet strength agents used nowadays in papermaking are based essentially on melamine resin or polyamidoamine-epichlorohydrin resin (PAAE resin). Both wet strength agents have the disadvantage that if paper waste is obtained, dry paper waste can be only poorly beaten again, i.e. returned to the headbox after comminution and re-suspension. Relatively large amounts of waste are accordingly easily obtained in the production of wet-strength paper.

In DE-A14436058, polyether-hydrophilized polyisocyanates are employed as wet strength agents in paper production. Such systems have a pot life and are processable only for minutes to hours. The reason for this is the reaction of the isocyanate with water, followed by degradation to the amine, which then adds on to still free isocyanate. The build up in molecular weight leads after a short time, the so-called "pot life", to a very high, unacceptable viscosity.

U.S. Pat. No. 3,971,764 A1, WO-A197/45395 and EP-A10165150 describe cationically hydrophilized polyurethane dispersions as pulp sizing agents in papermaking. Sizing of the paper is effected during drying of the paper and is not uncoupled in time from the drying. Beating of paper waste sized in this way is difficult. At any rate, further pulp sizing agent must be added to the beaten paper waste, which can lead to further process problems since metering of the renewed addition of pulp sizing agent is difficult. Interfering substances are formed, which in turn necessitate the addition of further chemicals. Sized paper which has already dried can no longer be beaten again and must be disposed of.

Radiation-curable aqueous polyurethane (meth)acrylate dispersions are known as binders for radiation-curable lacquers. The applications EP-A1753531, EP-A2/A3 1106633 and EP-A 1 1958974 are representative of these. These describe nonionically, anionically or cationically hydrophilized polyurethane (meth)acrylates which are employed as aqueous dispersions in particular for wood lacquers. The coating/lacquering of paper, cardboard or paperboard is also described inter alia. The use of these dispersions for the production of sized and/or wet-strength paper, cardboard or paperboard is not disclosed. A lacquer is not to be equated with a pulp sizing agent and/or wet strength agent which is employed in paper production, since a lacquer is a coating composition which is applied thinly to objects and is built up to a closed, solid film by chemical and/or physical processes. It has a protective, decorative or functional aim. A pulp sizing agent and/or wet strength agent for production of sized and/or wet-strength papers, paperboards or cardboards, on the other hand, is mixed with the chemical pulp and/or wood pulp, is within the paper after the papermaking, accordingly does not form a closed film, possibly reacts with the cellulose fibre or is deposited on it in places, and has the function of hydrophobizing the cellulose fibres and imparting dimensional stability to the paper, the paperboard or the cardboard in the wet state.

Conventional processes known from the prior art using the known pulp sizing agents and/or wet strength agents have disadvantages in the process of paper production: precise control of the reaction parameters (e.g. pH), lack of storage stability of the dispersions employed and lack of re-beatability of the paper waste obtained, i.e. being returnable to the headbox again after comminution and suspension.

The object was to provide a novel improved process for the production of sized and/or wet-strength paper, paperboard and cardboard which overcomes the disadvantages mentioned. Furthermore, the dispersions employed as pulp sizing agents and/or wet strength agents in the process according to the invention should have good retention properties, i.e. should be absorbed efficiently on to the cellulose fibres, and should be usable in various formulations and under variable conditions (e.g. temperature, concentration). In particular, re-beatability of the paper waste obtained should be achieved, i.e. the paper waste should be returnable to the headbox again after comminution and suspension. Furthermore, the dispersions employed in the process according to the invention should be of low viscosity and have a higher solids content than the AKD or ASA dispersions conventional hitherto.

It has been found, surprisingly, that in the process according to the invention an aqueous radiation-curable dispersion containing at least one polymer, characterized in that the polymer contains cationic groups, is outstandingly suitable for the production of sized and/or wet-strength paper, paperboard and cardboard and for hydrophobizing cellulose fibres. In the process according to the invention, the sizing or hydrophobizing action is achieved only after the radiation curing of the already dried paper. This has the advantage that paper, paperboard and cardboard which has already been dried but not yet subjected to radiation-curing can be beaten again, i.e. the paper waste does not have to be disposed of but can easily be fed back to the papermaking process. As a result, the process according to the invention is more flexible than the processes known hitherto.

It was known hitherto only that closed films of aqueous radiation-curable binders can be cured by means of radiation. It would therefore have been expected that a high absorption of the high-energy radiation by the chemical pulp or wood pulp would take place, so that no sizing by irradiation takes place in the process according to the invention. It has been found, surprisingly, that a sizing and/or wet strengthening of the paper, the paperboard and the cardboard is achieved by irradiation.

SUMMARY OF THE INVENTION

This invention provides a process for the production of sized and/or wet-strength papers, paperboards and cardboards, wherein an aqueous radiation-curable dispersion containing at least one polymer, characterized in that the polymer contains cationic groups, is mixed with suspended wood pulp and/or chemical pulp and this mixture is sieved, pressed, thermally dried and then subjected to radiation curing, characterized in that the radiation-curable dispersion is employed in amounts, based on its non-aqueous content in relation to the solid content of the wood pulp and/or chemical pulp, of from 0.001 to 10 wt. %, particularly preferably 0.01 to 5 wt. %, very particularly preferably 0.1 to 3 wt. %.

BRIEF DESCRIPTION OF THE SEVERAL DRAWINGS

DETAILED DESCRIPTION OF THE PREFERRED EMBODIMENTS

Figure 1:
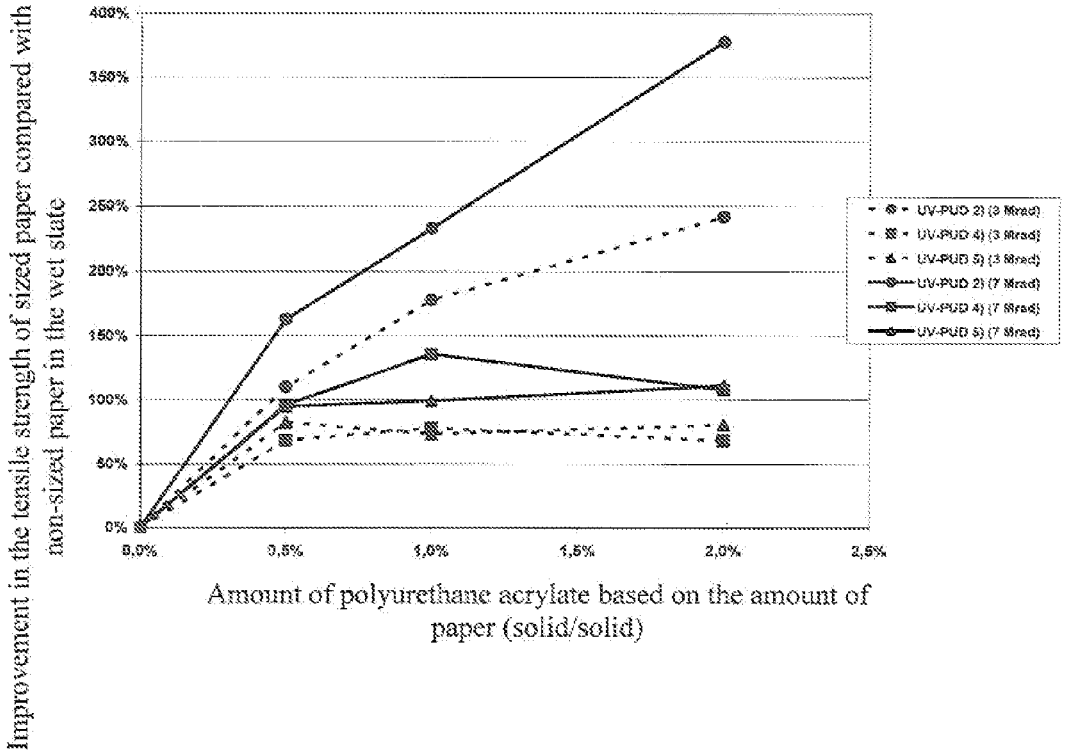
FIG. 1 is a graph showing the relative improvement in the tensile strength of size paper compared with non-sized paper in the wet state determination of the wet strength; curing was via electron beams, radiation dose in parentheses.

The invention also provides compositions comprising suspended wood pulp and/or chemical pulp and an aqueous radiation-curable dispersion containing at least one polymer, characterized in that the radiation-curable dispersion is present in amounts, based on its non-aqueous content in relation to the solid content of the wood pulp and/or chemical pulp, of from 0.001 to 10 wt. %, and in that the polymer contains cationic groups.

The aqueous radiation-curable dispersion is characterized in that it contains radiation-curable unsaturated groups which are bonded to the polymer (ii) and/or are present in the form of radiation-curable monomers, so-called reactive diluents (i).

Suitable polymers containing cationic groups are, for example, polymers based on polyester, polyurethane, polyepoxy, polyether, polyamide, polysiloxane, polycarbonate, polyepoxy(meth)acrylate, polyester (meth)acrylate, polyurethane poly(meth)acrylate and/or poly(meth)acrylate It is advantageous if the content of radiation-curable double bonds of the dispersion is between 0.3 and 6.0 mol, preferably between 0.4 and 4.0 mol, particularly preferably between 0.5 and 3.0 mol per 1 kg of the non-aqueous constituents of the dispersion, stated in the following as mol/kg of non-aqueous constituents.

It is advantageous if the dispersion has a weight-average molecular weight $M_w$ of from 1,500 to 3,000,000 g/mol, preferably 2,000 to 500,000 g/mol, particularly preferably 2,500 to 100,000 g/mol. The weight-average molecular weight $M_w$ was determined by means of gel permeation chromatography with polystyrene as the standard.

It is advantageous if the density of cationic groups in the dispersion is between 0.05 and 10.0 mmol, preferably between 0.1 and 5.0 mmol, particularly preferably between 0.2 and 3.0 mmol per 1 kg of the non-aqueous constituents of the dispersion, stated in the following as mmol/kg of non-aqueous constituents.

It is advantageous if the average particle size of the dispersion is between 5 and 500 nm, preferably between 30 and 300 nm, particularly preferably between 50 and 200 nm. The average particle size is determined by means of laser correlation spectroscopy.

In one embodiment, the radiation-curable dispersion comprises one or more polyurethane (meth)acrylates (ii) and optionally one or more reactive diluents (i) containing at least one radiation-curable unsaturated group.

Preferably, polyurethane (meth)acrylates (ii) are the reaction products of:

1) one or more compounds with at least one group which is reactive towards isocyanate and at least one unsaturated group which can undergo free radical polymerization,
2) optionally one or more monomeric and/or polymeric compounds which differ from 1),
3) one or more compounds with at least one group which is reactive towards isocyanate and additionally at least one cationic and/or potentially cationic group,
4) one or more organic polyisocyanates and
5) optionally compounds which differ from 1) to 3) and have at least one amine function.

In the context of this invention, "(meth)acrylate" relates to corresponding acrylate or methacrylate functions or to a mixture of the two.

Component 1) comprises one or more compounds with at least one group which is reactive towards isocyanate and at least one unsaturated group which can undergo free radical polymerization. Such compounds are, for example, oligomers and polymers containing unsaturated groups, such as polyester (meth)acrylates, polyether (meth)acrylates, polyether-ester (meth)acrylates, unsaturated polyesters with allyl ether structural units, polyepoxy(meth)acrylates and monomers containing unsaturated groups with a molecular weight of <700 g/mol and combinations of the compounds mentioned.

Of the polyester (meth)acrylates, the polyester (meth)acrylates which contain hydroxyl groups and have an OH number in the range of from 15 to 300 mg of KOH/g of substance, preferably from 60 to 200 mg of KOH/g of substance, are employed as component 1). In total 7 groups of monomer constituents ((a)-(g)) can be used as component 1) in the preparation of the hydroxy-functional polyester (meth)acrylates.

The first group (a) contains alkanediols or diols or mixtures of these. The alkanediols have a molecular weight in the range of from 62 to 286 g/mol. The alkanediols are preferably chosen from the group of ethanediol. 1,2- and 1,3-propanediol, 1,2-, 1,3- and 1,4-butanediol, 1,5-pentanediol, 1,6-hexanediol, neopentyl glycol, cyclohexane-1,4-dimethanol, 1,2- and 1,4-cyclohexanediol, 2-ethyl-2-butylpropanediol. Preferred diols are diols containing ether oxygen, such as diethylene glycol, triethylene glycol, tetraethylene glycol, dipropylene glycol, tripropylene glycol, polyethylene, polypropylene or polybutylene glycols with a number-average molecular weight Mn in the range of from 200 to 4,000, preferably 300 to 2,000, particularly preferably 450 to 1,200 g/mol. Reaction products of the abovementioned diols with ϵ-caprolactone or other lactones can likewise be employed as diols.

The second group (b) contains trifunctional and more than trifunctional alcohols having a molecular weight in the range of from 92 to 254 g/mol and/or polyethers started on these alcohols. Particularly preferred trifunctional and more than trifunctional alcohols are glycerol, trimethylolpropane, pentaerythritol, dipentaerythritol and sorbitol. A particularly preferred polyether is the reaction product of 1 mol of trimethylolpropane with 4 mol of ethylene oxide.

The third group (c) contains monoalcohols. Particularly preferred monoalcohols are chosen from the group of ethanol, 1- and 2-propanol, 1- and 2-butanol, 1-hexanol, 2-ethylhexanol, cyclohexanol and benzyl alcohol.

The fourth group (d) contains dicarboxylic acids having a molecular weight in the range of from 104 to 600 g/mol and/or anhydrides thereof. Preferred dicarboxylic acids and anhydrides thereof are chosen from the group of phthalic acid, phthalic anhydride, isophthalic acid, tetrahydrophthalic acid, tetrahydrophthalic anhydride, hexahydrophthalic acid, hexahydrophthalic anhydride, cyclohexanedicarboxylic acid, maleic anhydride, fumaric acid, malonic acid, succinic acid, succinic anhydride, glutaric acid, adipic acid, pimelic acid, suberic acid, sebacic acid, dodecandioic acid, hydrogenated dimers of fatty acids such as are listed under the sixth group (f).

The fifth group (c) contains trimellitic acid or trimellitic anhydride.

The sixth group (f) contains monocarboxylic acids, such as e.g. benzoic acid, cyclohexanecarboxylic acid, 2-ethylhexanoic acid, caproic acid, caprylic acid, capric acid, lauric acid, and natural and synthetic fatty acids, such as e.g. lauric, myristic, palmitic, margaric, stearic, behenic, cerotic, palmitoleic, oleic, icosenic, linoleic, linolenic and arachidonic acid.

The seventh group (g) contains acrylic acid, methacrylic acid and/or dimeric acrylic acid.

Suitable polyester (meth)acrylates 1) containing hydroxyl groups contain the reaction product of at least one constituent from group (a) or (b) with at least one constituent from group (d) or (c) and at least one constituent from group (g). Particularly preferred constituents from group (a) are chosen from the group consisting of ethanediol, 1,2- and 1,3-propanediol, 1,4-butanediol, 1,6-hexanediol, neopentyl glycol, cyclohexane-1,4-dimethanol, 1,2- and 1,4-cyclohexanediol, 2-ethyl-2-butylpropanediol, diols containing ether oxygen, chosen from the group of diethylene glycol, triethylene glycol, tetraethylene glycol, dipropylene glycol, and tripropylene glycol. Preferred constituents from group (b) are chosen from the group of glycerol, trimethylolpropane, pentaerythritol or the reaction product of 1 mol of trimethylolpropane with 4 mol of ethylene oxide. Particularly preferred constituents from groups (d) and (e) are chosen from the group of phthalic anhydride, isophthalic acid, tetrahydrophthalic anhydride, hexahydrophthalic acid, hexahydrophthalic anhydride, maleic anhydride, fumaric acid, succinic anhydride, glutaric acid, adipic acid, dodecandioic acid, hydrogenated dimers of fatty acids such as are listed under the 6th group (f) and trimellitic anhydride. The preferred constituent from group (g) is acrylic acid.

Groups having a dispersing action which are generally known can optionally also be incorporated into these polyester (meth)acrylates. Thus, polyethylene glycols and/or methoxypolyethylene glycols can be used as a proportion of the alcohol component. Polyethylene glycols, polypropylene glycols and block copolymers thereof started on alcohols and the monomethyl ethers of these polyglycols can be used as compounds. Polyethylene glycol monomethyl ether having a number-average molecular weight Mn in the range of from 500 to 1,500 g/mol is particularly suitable.

It is furthermore possible, after the esterification, to react some of the still free, non-esterified carboxyl groups, in particular those of (meth)acrylic acid, with mono-, di- or polyepoxides. Preferred polyepoxides are the glycidyl ethers of monomeric, oligomeric or polymeric bisphenol A, bisphenol F, hexanediol and/or butanediol or ethoxylated and/or propoxylated derivatives thereof. This reaction can be used, in particular, for increasing the OH number of the polyester (meth)acrylate, since in each case an OH group is formed in the polyepoxide-acid reaction. The acid number of the resulting product is between 0 and 20 mg of KOH/g, preferably between 0 and 10 mg of KOH/g and particularly preferably between 0 and 5 mg of KOH/g of substance. The reaction is preferably catalysed by catalysts, such as triphenylphosphine, thiodiglycol, ammonium and/or phosphonium halides and/or compounds of zirconium or tin, such as tin(II) ethylhexanoate.

The preparation of polyester (meth)acrylates is described on page 3, line 25 to page 6, line 24 of DE-A 4 040 290, on page 5, line 14 to page 11, line 30 of DE-A 3 316 592 and page 123 to 135 of P. K. T. Oldring (ed.) in Chemistry & Technology of UV & EB Formulations For Coatings, Inks & Paints, vol. 2, 1991, SITA Technology, London.

Polyether (meth)acrylates which contain hydroxyl groups and originate from the reaction of acrylic acid and/or methacrylic acid with polyethers are likewise suitable as component 1), thus e.g. homo-, co- or block copolymers of ethylene oxide, propylene oxide and/or tetrahydrofuran on any desired hydroxy- and/or amine-functional starter molecules, such as e.g. trimethylolpropane, ethylene glycol, propylene glycol, diethylene glycol, dipropylene glycol, glycerol, pentaerythritol neopentyl glycol, butanediol and hexanediol.

The polyepoxy(meth)acrylates, which are known per se, which contain hydroxyl groups and have an OH number in the range of from 20 to 300 mg of KOH/g, preferably from 100 to 280 mg of KOH/g, particularly preferably from 150 to 250 mg of KOH/g or polyurethane (meth)acrylates which contain hydroxyl groups and have an OH number in the range of from 20 to 300 mg of KOH/g, preferably from 40 to 150 mg of KOH/g, particularly preferably from 50 to 140 mg of KOH/g, are likewise suitable as component 1). Such compounds are likewise described on page 37 to 56 in P. K. T. Oldring (ed.), Chemistry & Technology of UV & EB Formulations For Coatings, Inks & Paints, vol. 2, 1991, SITA Technology, London. Polyepoxy(meth)acrylates containing hydroxyl groups are based in particular on reaction products of acrylic acid and/or methacrylic acid with polyepoxides (glycidyl compounds) of monomeric, oligomeric or polymeric bisphenol A, bisphenol F, hexanediol and/or butanediol or ethoxylated and/or propoxylated derivatives thereof.

Monohydroxy-functional alcohols containing (meth)acrylate groups, such as, for example, 2-hydroxyethyl(meth)acrylate, caprolactone-lengthened modifications of 2-hydroxyethyl(meth)acrylate, such as Pemcure® 12A (Cognis, DE), 2-hydroxypropyl(meth)acrylate, 4-hydroxybutyl(meth)acrylate, 3-hydroxy-2,2-dimethylpropyl(meth)acrylate, the di-, tri- or penta(meth)acrylates, which are on average monohydroxy-functional, of polyhydric alcohols, such as trimethylolpropane, glycerol, pentaerythritol, ditrimethylolpropane, dipentaerythritol, ethoxylated, propoxylated or alkoxylated trimethylolpropane, glycerol, pentaerythritol, ditrimethylolpropane, dipentaerythritol or technical grade mixtures thereof, are likewise suitable as component 1).

The reaction products of (meth)acrylic acids with monomeric epoxide compounds which optionally contain double bonds can moreover also be employed as monohydroxy-functional alcohols containing (meth)acrylate groups. Preferred reaction products are chosen from the group of (meth)acrylic acid with glycidyl (meth)acrylate or the glycidyl ester of a tertiary saturated monocarboxylic acid. Tertiary saturated monocarboxylic acids are, for example, 2,2-dimethylbutyric acid, ethylmethylbutyric, ethylmethylpentanoic, ethylmethylhexanoic, ethyl-methylheptanoic and/or ethylmethyloctanoic acid.

The compounds listed under component 1) can be used by themselves or also as mixtures.

Component 2) may comprise monomeric mono-, di- and/or triols in each case having a molecular weight of from 32 to 240 g/mol, such as e.g. methanol, ethanol, 1-propanol, 1-butanol, 1-pentanol, 1-hexanol, 2-propanol, 2-butanol, 2-ethylhexanol, ethylene glycol, diethylene glycol, triethylene glycol, tetraethylene glycol, dipropylene glycol, tripropylene glycol, 1,2-propanediol, 1,3-propanediol, 1,4-butanediol, neopentyl glycol, 2-ethyl-2-butylpropanediol, trimethylpentanediol, 1,3-butylene glycol, 1,4-cyclohexanedimethanol, 1,6-hexanediol, 1,2- and 1,4-cyclohexanediol, hydrogenated bisphenol A (2,2-bis(4-hydroxycyclohexyl)propane), diols derived from dimer fatty acids, 2,2-dimethyl-3-hydroxypropionic acid (2,2-dimethyl-3-hydroxypropyl ester), glycerol, trimethylolethane, trimethylolpropane, trimethylolbutane and/or castor oil. Neopentyl glycol, 1,4-butanediol, 1,4-cyclohexanedimethanol, 1,6-hexanediol and/or trimethylolpropane are preferred.

Component 2) furthermore may comprise oligomeric and/or polymeric hydroxy-functional compounds. These oligomeric and/or polymeric hydroxy-functional compounds are, for example, polyesters, polycarbonates, polyether-carbonate polyols, C2-, C3- and/or C4-polyethers, polyether esters and/or polycarbonate polyesters having a functionality of from 1.0 to 3.0, in each case with a weight-average of the molecular weight Mw in the range of from 300 to 4,000, preferably 500 to 2,500 g/mol.

Hydroxy-functional polyester alcohols are those based on mono-, di- and tricarboxylic acids with monomeric di- and triols, such as have already been listed as component 2), and polyester alcohols based on lactones. The carboxylic acids are, for example, phthalic acid, isophthalic acid, terephthalic acid, trimellitic acid, adipic acid, maleic acid, fumaric acid, tetrahydrophthalic acid, hexahydrophthalic acid, malonic acid, succinic acid, glutaric acid, pimelic acid, suberic acid, sebacic acid, dodecanedioic acid, hydrogenated dimers of fatty acids and saturated and unsaturated fatty acids, such as e.g. palmitic acid, stearic acid, myristoleic acid, palmitoleic acid, oleic acid, linoleic acid, linolenic acid, castor oil acid and technical grade mixtures thereof. Of the di- and tricarboxylic acids, the analogous anhydrides can also be used.

Hydroxy-functional polyether-ols are obtainable, for example, by polymerization of cyclic ethers or by reaction of alkylene oxides with a starter molecule. Hydroxy-functional polycarbonates are hydroxyl-terminated poly-carbonates, the polycarbonates accessible by reaction of diols, lactone-modified diols or bisphenols, e.g. bisphenol A, with phosgene or carbonic acid diesters, such as diphenyl carbonate or dimethyl carbonate. Hydroxy-functional polyether carbonate polyols are those such as are described for building up polyurethane dispersions in DE-A 102008000478.

The polymeric, hydroxy-functional polyesters, polycarbonates, polyether carbonate polyols, $C_1$-, $C_3$- and/or $C_4$-polyethers, polyether esters and/or polycarbonate polyesters with an average OH functionality of from 1.8 to 2.3, particularly preferably 1.9 to 2.1, are preferred as component 2).

Component 3) may comprise compounds with at least one group which is reactive towards isocyanate and additionally at least one cationic and/or potentially cationic group. The potentially cationic groups are converted into the corresponding cationic groups, for example, by salt formation. Suitable cationic groups are ammonium groups, potentially cationic groups are primary, secondary or tertiary amino groups, particularly preferred potentially cationic groups are tertiary amino groups. Isocyanate-reactive groups which are preferably suitable are hydroxyl and primary or secondary amino groups.

Compounds with potentially cationic groups which are suitable as component 3) are, for example, ethanolamine, diethanolamine, triethanolamine, 2-propanolamine, dipropanolamine, tripropanolamine, N-methylethanolamine, N-methyl-diethanolamine and N,N-dimethylethanolamine, preferably triethanolamine, tripropanolamine, N-methylethanolamine, N-methyl-diethanolamine and N,N-dimethylethanolamine, particularly preferably N-methyl-diethanolamine and N,N-dimethylethanolamine.

The potentially cationic groups are converted into the corresponding salts by reaction with neutralizing agents, such as e.g. inorganic acids, such as, for example, hydrochloric acid, phosphoric acid and/or sulfuric acid, and/or organic acids, such as, for example, formic acid, acetic acid, lactic acid, methane-, ethane- and/or p-toluenesulfonic acid. In this context, the degree of neutralization is preferably between 50 and 125%. In the case of base-functionalized polymers, the degree of neutralization is defined as the quotient of acid and base. If the degree of neutralization is above 100%, in the case of base-functionalized polymers more acid is added than there are base groups present in the polymer.

The compounds listed under component 3) can also be used in mixtures.

Component 4) may comprise polyisocyanates chosen from the group of aromatic, araliphatic, aliphatic or cycloaliphatic polyisocyanates or mixtures of such polyisocyanates. Suitable polyisocyanates are, for example, 1,3-cyclohexane-diisocyanate, 1-methyl-2,4-diisocyanato-cyclohexane, 1-methyl-2,6-diisocyanato-cyclohexane, tetramethylene-diisocyanate, 4,4'-diisocyanatodiphenylmethane, 2,4'-diisocyanatodiphenylmethane, 2,4-diisocyanatotoluene, 2,6-diisocyanatotoluene, α,α,α',α'-tetramethyl-m- or -p-xylylene-diisocyanate, 1,6-hexamethylene-diisocyanate, 1-isocyanato-3,3,5-trimethyl-5-isocyanatomethylcyclohexane (isophorone-diisocyanate or IPDI), 4,4'-diisocyanato-dicyclohexylmethane, 4-isocyanatomethyl-1,8-octane-diisocyanate (triisocyanatononane, TIN) (EP-A 928 799), homologues or oligomers of these polyisocyanates listed with biuret, carbodiimide, isocyanurate, allophanate, iminooxadiazinedione and/or uretdione groups, and mixtures thereof. Compounds with at least two free isocyanate groups, at least one allophanate group and at least one C=C double bond which can undergo free radical polymerization and is bonded via the allophanate group, such as are described as component a) in WO-A 2006/089935, are likewise suitable as component 4). 1,6-Hexamethylene-diisocyanate, 1-isocyanato-3,3,5-trimethyl-5-isocyanatomethylcyclohexane (isophorone-diisocyanate or IPDI) and 4,4'-diisocyanato-dicyclohexylmethane, homologues or oligomers of 1,6-hexamethylene-diisocyanate, 1-isocyanato-3,3,5-trimethyl-5-isocyanatomethyl-cyclohexane (isophorone-diisocyanate or IPDI) and 4,4'-diisocyanato-dicyclohexylmethane with biuret, carbodiimide, isocyanurate, allophanate, iminooxadiazinedione and/or uretdione groups and allophanate (meth) acrylates as described in WO-A 2006/089335 and mixtures thereof are preferred as component 4).

Mono- and diamines and/or mono- or difunctional amino alcohols are maybe as component 5) to increase the weight-average molecular weight Mw of the polyurethane (meth) acrylates (ii) according to the invention. Preferred diamines are those which are more reactive towards the isocyanate groups than water, since the lengthening of the polyurethane (meth)acrylates optionally takes place in an aqueous medium. The diamines are particularly preferably chosen from the group of ethylenediamine, 1,6-hexamethylenediamine, isophoronediamine, 1,3-, 1,4-phenylenediamine, piperazine, 4,4'-diphenylmethanediamine, amino-functional polyethylene oxides, amino-functional polypropylene oxides (known under the name Jeffamin® D series [Huntsman Corp. Europe, Zavantem, Belgium]) and hydrazine, ethylenediamine is very particularly preferred.

Preferred monoamines are chosen from the group of butylamine, ethylamine and amines of the Jeffamin® M series (Huntsman Corp. Europe, Zavantem, Belgium), amino-functional polyethylene oxides, amino-functional polypropylene oxides and/or amino alcohols.

Reactive diluents (i) are to be understood as compounds which contain at least one group which can undergo free radical polymerization, preferably acrylate and methacrylate groups, and preferably no groups which are reactive towards isocyanate or hydroxyl groups. Preferred compounds (i) contain 2 to 6 (meth)acrylate groups, particularly preferably 4 to 6.

Particularly preferred reactive diluents (i) have a boiling point of more than 200° C. under normal pressure.

Reactive diluents are described generally in P. K. T. Oldring (editor), Chemistry & Technology of UV & EB Formulations for Coatings, Inks & Paints, vol. II, chapter III: Reactive Diluents for UV & EB Curable Formulations, Wiley and SITA Technology, London 1997.

Reactive diluents (i) may be, for example, the alcohols methanol, ethanol, 1-propanol, 1-butanol, 1-pentanol, 1-hexanol, 2-propanol, 2-butanol, 2-ethylhexanol, dihydrodicyclopentadienol, tetrahydrofurfuryl alcohol, 3,3,5-trimethylhexanol, octanol, decanol, dodecanol, ethylene glycol, diethylene glycol, triethylene glycol, tetraethylene glycol, dipropylene glycol, tripropylene glycol, 1,2-propanediol, 1,3-propanediol, 1,4-butanediol, neopentyl glycol, 2-ethyl-2-butylpropanediol, trimethylpentanediol, 1,3-butylene glycol, 1,4-cyclohexanedimethanol, 1,6-hexanediol, 1,2- and 1,4-cyclohexanediol, hydrogenated bisphenol A (2,2-bis(4-hydroxycyclohexyl)propane), glycerol, trimethylolethane, trimethylolpropane, trimethylolbutane, pentaerythritol, ditrimethylolpropane, dipentaerythritol and sorbitol esterified completely with (meth)acrylic acid, and ethoxylated and/or propoxylated derivatives of the alcohols listed and the technical grade mixtures obtained during (meth)acrylation of the abovementioned compounds.

All the processes known from the prior art can be used for the preparation of the aqueous radiation-curable dispersions, preferably aqueous dispersions based on polyurethane (meth) acrylate, such as emulsifier-shearing force, acetone, prepolymer mixing, melt emulsification, ketimine and solid spontaneous dispersing processes or derivatives thereof. A summary of these methods is found in e.g. Methoden der Organischen Chemie, Houben-Weyl, 4th edition, volume E20/part 2 on page 1659, Georg Thieme Verlag, Stuttgart, 1987. The melt emulsification and the acetone process are preferred. The acetone process is particularly preferred.

In the process according to the invention, the aqueous radiation-curable dispersion is mixed under shearing forces with the wood pulp and/or chemical pulp, optionally with the addition of further paper chemicals and/or additives, before the headbox. Application via the headbox to a sieve and further steps typical of industrial production of paper-, cardboard or paperboard, such as e.g. pressing and thermal drying, follow. The dried paper, paperboard or cardboard is subjected to radiation curing, the actual sizing and/or wet strengthening taking place. The paper, the paperboard or the cardboard can undergo further processing steps before or after the radiation curing, such as e.g. application of the surface sizing, satinizing and/or application of a staining colour (see information in J. Blechschmidt, Taschenbuch der Papiertechnik, Carl Hanser Verlag, Munich, 2010). In the process according to the invention, the paper waste which has already dried but has not yet been subjected to radiation curing can be beaten again, i.e. can be fed back to the headbox, that is to say into the process, after comminution and re-suspension. This is a considerable advantage of the process according to the invention compared with the known processes.

The dispersions employed in the process according to the invention are compatible with other paper chemicals or additives, such as e.g. calcium salts or magnesium salts. The actual sizing and/or wet strengthening first takes place in the dry paper, the paperboard or the cardboard and is thus largely independent of the pH. Precisely the accurate maintaining of the pH plays an essential role in resin, ASA or AKD sizing and rapidly leads to certain paper chemicals or additives being ruled out.

Dried paper, paperboard and cardboard which has been produced by the process according to the invention can be rolled up before the radiation curing and unrolled again, optionally at a different location, for the radiation curing at a later point in time.

In the process according to the invention, electromagnetic radiation of which the energy, optionally with the addition of suitable photoinitiators, is sufficient to effect free radical polymerization of (meth)acrylate double bonds is suitable for the radiation curing of the paper, the paperboard or the cardboard.

The polymerization induced by radiation chemistry is preferably carried out by means of radiation with a wavelength of less than 400 nm, which is preferably UV rays and/or electron beams.

If UV radiation is used, the curing is initiated in the presence of photoinitiators. A distinction is made in principle between two type of photoinitiators, the unimolecular type (I) and the bimolecular type (II). Suitable type (I) systems are aromatic ketone compounds, such as e.g. benzophenones in combination with tertiary amines, alkylbenzophenones, 4,4'-bis(dimethylamino)benzophenone (Michler's ketone), anthrone and halogenated benzophenones or mixtures of the types mentioned. Type (II) initiators, such as benzoin and its derivatives, benzil ketals, acylphosphine oxides, 2,4,6-trimethyl-benzoyl-diphenylphosphine oxide, bisacylphosphine oxides, phenylglyoxylic acid esters, camphorquinone, α-aminoalkylphenones, α,α-dialkoxyacetophenones and α-hydroxyalkylphenones, are furthermore suitable. Photoinitiators which can easily be incorporated into the aqueous dispersions are preferred. Such products are, for example, Irgacure® 500 (a mixture of benzophenone and (1-hydroxycyclohexyl)phenyl ketone, BASF SE, Ludwigshafen, DE), Irgacure® 819 DW (phenyl-bis-(2,4,6-trimethylbenzoyl)-phosphine oxide, BASF SE, Ludwigshafen, DE), Esacure® KIP EM (oligo-[2-hydroxy-2-methyl-1-[4-(1-methylvinyl)-phenyl]-propanone], Lamberti, Aldizzate, Italy). Mixtures of these compounds can also be employed.

It may be advantageous to bind the photoinitiator covalently to the polymer dispersed in water. For polyurethane (meth)acrylate dispersions e.g. an OH-functional photoinitiator, such as e.g. Irgacure® 2959 (1-[4-(2-hydroxyethoxy)-phenyl]-2-hydroxy-2-methyl-1-propane-1-one, BASF SE, Ludwigshafen, DE), is suitable for being bound to the polyurethane (meth)acrylate via addition on to NCO-functional groups.

Polar solvents, such as e.g. acetone and isopropanol, can also be used for incorporation of the photoinitiators.

An electron beam is particularly preferred for the radiation curing.

The radiation curing can be carried out at any temperature which the paper, the paperboard and the cardboard withstand without damage. The radiation curing is advantageously carried out at 30 to 70° C. since at temperatures above room temperature (23° C.) a higher conversion of the polymerizable double bonds in the dispersions takes place and the paper, the paperboard and the cardboard remain undamaged.

If appropriate, curing is carried out under an inert gas atmosphere, i.e. with exclusion of oxygen, in order to prevent inhibition of the free radical crosslinking by oxygen.

In the process according to the invention, the dispersions can also be combined with other pulp sizing agents and/or wet strength agents, such as, for example, resin sizing agents, AKD dispersions, ASA dispersions, polyurethane dispersions, melamine resins, PAAE resins and glyoxal resins. It is likewise possible to employ them together with crosslinking agents, such as e.g. blocked and/or non-blocked polyisocyanate, which can be hydrophilized or non-hydrophilized, polyaziridines and polycarbodiimides.

Preferably, the dispersions are not combined with other pulp sizing agents and/or wet strength agents.

In the process according to the invention, the mineral and chemical additives known in paper technology, such as e.g. mineral fillers and pigments, retention agents, dewatering accelerators, fixing agents, optical brighteners, dyestuffs and biocides, can be added to or combined with the dispersions.

The present invention also provides papers, paperboards and cardboards produced by the process according to the invention.

Papers, cardboards and paperboards which are produced by the process according to the invention are distinguished by a readily adjustable hydrophobicity. Their production process becomes more flexible, since the actual sizing takes place only by the radiation curing and is therefore uncoupled from the thermal drying. This has the advantage that paper which has once dried but has not yet been subjected to radiation curing can easily be beaten again and fed to the headbox (reduction in paper waste). Furthermore, in the process according to the invention there is practically no pH dependency, as in the conventional processes, such as, for example, of resin sizing, AKD sizing or ASA sizing. The dispersions employed in the process according to the invention are distinguished by a comparatively high non-aqueous content, are of low viscosity and are more storage-stable than conventional AKD or ASA dispersions.

Examples

Methods

The NCO content was in each case monitored titrimetrically in accordance with DIN 53185.

The solids content of the polyurethane dispersion was determined gravimetrically after all the non-aqueous constituents had been evaporated off, in accordance with DIN 53216.

The average particle size was determined by laser correlation spectroscopy. The flow time was determined in accordance with DIN 53211 with the aid of the 4 mm DIN cup.

The determination of the weight-average molecular weight $M_w$ of the polyurethane (meth)acrylates by means of gel permeation chromatography was carried out on the following system:

| | |
|---|---|
| Pump | Hewlett Packard 1100 series II |
| Injector | Hewlett Packard 1100 series II |
| Column oven | VDS-Optilab Jetstream 2 Plus |
| Detector | Refractive index detector, Hewlett Packard 1100 series II |
| Columns | 1. PSS HEMA 40; 50 × 7.8 mm<br>2. PSS HEMA 1000; 300 × 7.8 mm<br>3. PSS HEMA 300; 300 × 7.8 mm<br>4. PSS HEMA 40; 300 × 7.8 mm<br>5. PSS HEMA 40; 300 × 7.8 mm |
| Mobile phase | N,N-Dimethylacetamide |
| Flow rate | 0.6 ml/min |
| Pressure | 100 bar |
| Temperature | 30° C. |
| Injection volume | 100 μl |
| Sample concentration | 13.4 g/l |
| Standard for the molecular weight | PSS Polymer-Standard-Service GmbH, Mainz, DE |
| Molecular samples [g/mol] | 162; 374; 1620; 9130; 18100; 32500; 67500; 128000; 246000; 659000; 1000000 |

The viscosity of the polyester acrylate was determined on a ball and plate viscometer at 23° C. and at a shear rate of 40/sec in accordance with DIN 53019.

The OH number was determined in accordance with DIN 53240 using acetic anhydride, the acid number in accordance with DIN EN ISO 2114 and the iodine colour number in accordance with DIN 6162.

The turbidity was determined on a turbidimeter from Hach, type 2100 AN, in accordance with DIN EN ISO 7027. The unit is TU (turbidity unit).

Synthesis of the Aqueous Radiation-Curable Polymer Dispersions

1) Polyester Acrylate 58.8 g of maleic anhydride, 734.4 g of ethoxylated trimethylolpropane of OH number 550, 77.6 g of polyethylene glycol 1500, 78.4 g of diethylene glycol, 12.5 g of p-toluenesulfonic acid, 0.1 g of toluhydroquinone and 300 g of isooctane were stirred under reflux in a heatable reaction vessel with a stirrer, internal thermometer, gas inlet and distillation attachment for 4 hours while passing a stream of nitrogen over. 345.6 g of acrylic acid, 3.5 g of p-toluenesulfonic acid, 3.6 g of hydroquinone monomethyl ether and 0.3 g of 2,5-di-tert-butylhydroquinone were then added to the cooled mixture. The mixture was heated on a water separator with vigorous boiling for approx. 14 hours while passing a stream of air through. The reaction was ended when the acid number of the mixture had fallen below 4 mg of KOH/g. After cooling to 80° C., 36.8 g of the diglycidyl ether of bisphenol A were added and isooctane was distilled off in vacuo (50 mbar). The polyester acrylate 1) had an iodine colour number of 0.7, a viscosity of 390 mPa·s at 23° C. and an OH number of 128 mg of KOH/g of substance.

2) Preparation of an Aqueous Radiation-Curable Aqueous Polyurethane Acrylate Dispersions Diluted to the Same Extent with Water, without Polyurethane Acrelate Dispersion (According to the Invention)

528 parts of the polyester acrylate 1), component 1), 23.8 parts of N-methyldiethanolamine, component 3), 178 parts of 1-isocyanato-3,3,5-trimethyl-5-isocyanatomethylcyclohexane, component 4), 0.75 part of 2,6-di-tert-butyl-4-cresol and 0.30 part of dibutyltin dilaurate were reacted at 60° C. to an NCO content of 0.1 wt. %, while stirring. Neutralization by addition and stirring in of 19.1 parts of lactic acid followed. 1,100 parts of water were then introduced, with vigorous stirring. A radiation-curable aqueous polyurethane acrylate dispersion (UV-PUD 2) having a solids content of 40 wt. %, a flow time of 13 sec, an average particle size of 150 nm, a pH of 4.2, a double bond density of 3.5 mol/kg of non-aqueous content and a weight-average molecular weight $M_w$ of 5,121 g/mol was obtained. When applied to glass, this dispersion gave a tacky film after drying at 50° C. for 10 min.

3) Preparation of an Aqueous Radiation-Curable Polyurethane Acrylate Dispersion (According to the Invention)

86.2 parts of 2-hydroxyethyl acrylate, component 1), 10.7 parts of N-methyldiethanolamine, component 3), 195 parts of the hexamethylene-diisocyanate trimer Desmodur® N 3300 (Bayer MatcrialScience AG, Leverkusen, DE), component 4), 0.33 part of 2,6-di-tert-butyl-4-cresol and 0.08 part of dibutyltin dilaurate were dissolved in 76 parts of ethoxylated pentaerythritol tetraacrylate Photomer® 4172 F (Cognis AG, Düsseldorf, DE), component (i) and the solution was reacted at 60° C. to an NCO content of 0.1 wt. %, while stirring. Neutralization by addition and stirring in of 8.6 parts of lactic acid followed. 570 parts of water were then introduced into the clear solution, while stirring. A radiation-curable aqueous polyurethane acrylate dispersion (UV-PUD 3) having a solids content of 41 wt. %, a flow time of 32 sec, an average particle size of 71 nm, a pH of 3.6, a double bond density of 1.8 mol/kg of non-aqueous content and a weight-average molecular weight $M_w$ of 2,907 g/mol was obtained. When applied to glass, this dispersion gave a tacky film after drying at 50° C. for 10 min.

4) Preparation of an Aqueous Radiation-Curable Polyurethane Acrylate Dispersion (Comparison)

The aqueous, anionically hydrophilized radiation-curable polyurethane acrylate dispersion Bayhydrol® UV 2280 (Bayer MaterialScience AG, Leverkusen, DE) (UV-PUD 4) with a solids content of 38 wt. %, a flow time of 20 sec, an average particle size of 71 nm and a pH of 7.8 served as comparison 4). When applied to glass, this dispersion gave a tack-free film after drying at 50° C. for 10 min.

5) Preparation of an Aqueous Radiation-Curable Polyurethane Acrylate Dispersion (Comparison)

The aqueous, anionically hydrophilized radiation-curable polyurethane acrylate dispersion Bayhydrol® UV XP 2687 (Bayer MaterialScience AG, Leverkusen, DE) (UV-PUD 5) with a solids content of 50 wt. %, a flow time of 24 sec, an average particle size of 110 nm and a pH of 7.8 served as comparison 5). When applied to glass, this dispersion gave a tacky film after drying at 50° C. for 10 min.

Production of a Hand-Made Paper 40 g of newspaper were comminuted in 1,000 ml of water in a kitchen mixer at the maximum level for five minutes. A homogeneous, finely divided paper pulp was formed. 1 wt. % of Irgacure® 500 (a mixture of benzophenone and (1-hydroxycyclohexyl)phenyl ketone from BASF SE Ludwigshafen, DE; based on the aqueous delivery form) was incorporated via shearing forces into the radiation-curable aqueous polyurethane acrylate dispersions of Examples 2) to 5) and the dispersions obtained were diluted with water to a solids content 4 wt. %. Defined amounts of these radiation-curable aqueous polyurethane acrylate dispersions (Table 1) were stirred gently into a mixture of 40 g of the paper pulp prepared as described above and 960 ml of water in a glass beaker for one minute. The paper suspension obtained could then be filtered over a filter paper of 15 cm diameter. The filtrate (Table 1 and 2) was investigated further for determination of the retention properties of the polyurethane acrylate dispersions, and the paper (Table 3) for determination of the sizing.

Determination of the Retention Properties of the Polyurethane Acrylate Dispersions The turbidity of the filtrate after stirring the radiation-curable aqueous polyurethane acrylate dispersions with the paper pulp (Table 1) and with the radiation paper pulp (Table 2) was determined. Via the comparison of the turbidities of the filtrate of the dispersions with (Table 1) and without (Table 2) paper pulp, it can be determined how well the various dispersions are absorbed on to the cellulose fibre. As the reference value for the minimum turbidity of the filtrate, instead of with the radiation-curable aqueous polyurethane acrylate dispersion, the paper pulp was treated only with the corresponding amount of water (Table 1 and 2: "without UV-PUD").

TABLE 1

Evaluation of the retention properties: Determination of the turbidity of the filtrate after stirring with the paper pulp, stated in TU (turbidity unit)

| Without UV-PUD | Amount of polyurethane acrylate, based on the amount of paper (solid/solid) | UV-PUD 2) | UV-PUD 3) | UV-PUD 4) (comparison) | UV-PUD 5) (comparison) |
|---|---|---|---|---|---|
| 1.8 | 2.5 wt. %[1] | 5.8 | 3.3 | 57 | 400 |
| | 0.25 wt. %[2] | 4.3 | 2.3 | 10 | 30 |
| | 0.025 wt. %[3] | 2.0 | 2.7 | 1.5 | 11 |

[1] 1 g of a radiation-curable aqueous polyurethane acrylate dispersion (solids content 4 wt. %) was applied to 1.6 g of paper suspended in 1,000 ml of water.
[2] 0.1 g of a radiation-curable aqueous polyurethane acrylate dispersion (solids content 4 wt. %) was applied to 1.6 g of paper suspended in 1,000 ml of water.
[3] 0.01 g of a radiation-curable aqueous polyurethane acrylate dispersion (solids content 4 wt. %) was applied to 1.6 g of paper suspended in 1,000 ml of water.

TABLE 2

Comparison value for evaluation of the retention properties: Turbidities of the polyurethane acrylate dispersions diluted with the same amount of water as in Table 1, but without paper pulp, stated in TU (turbidity unit)

| Without UV-PUD | Solids content of the diluted UV-PUD | UV-PUD 2) | UV PUD 3) | UV-PUD 4) (comparison) | UV-PUD 5) (comparison) |
|---|---|---|---|---|---|
| 1.8 | 0.004 wt. %[4] | 359 | 150 | 60 | 574 |
| | 0.0004 wt. %[5] | 19 | 33.2 | 6.9 | 67 |
| | 0.00004 wt. %[6] | 1.8 | 6.9 | 1.8 | 6.3 |

TABLE 2-continued

| Comparison value for evaluation of the retention properties: Turbidities of the polyurethane acrylate dispersions diluted with the same amount of water as in Table 1, but without paper pulp, stated in TU (turbidity unit) | | | | | |
|---|---|---|---|---|---|
| Without UV-PUD | Solids content of the diluted UV-PUD | UV-PUD 2) | UV PUD 3) | UV-PUD 4) (comparison) | UV-PUD 5) (comparison) |

[4]1 g of a radiation-curable aqueous polyurethane acrylate dispersion (solids content 4 wt. %) was diluted with 1,000 ml of water.
[5]0.1 g of a radiation-curable aqueous polyurethane acrylate dispersion (solids content 4 wt. %) was diluted with 1,000 ml of water.
[6]0.01 g of a radiation-curable aqueous polyurethane acrylate dispersion (solids content 4 wt. %) was diluted with 1,000 ml of water.

Table 1 shows that the filtrates, in particular in the case of relatively large additions of radiation-curable aqueous polyurethane acrylate dispersion (Table 1, UV-PUD 2 and 3) have a distinctly lower turbidity than the corresponding filtrates without paper pulp (Table 2, UV-PUD 2 and 3). This means that large parts of the cationically hydrophilized polyurethane acrylate (Table 1, UV-PUD 2 and 3) of the dispersions according to the invention are absorbed on to the cellulose fibres.

The person skilled in the art refers to very good retention properties of the sizing agent. During the addition of the radiation-curable aqueous polyurethane acrylate dispersions 2) and 3) to the paper pulp, a clear flocculation of the paper particles was already to be observed, which likewise indicates very good retention properties.

The turbidities of the filtrates of the comparison examples UV-PUD 4) and 5) (Table 1) with paper pulp show scarcely a decrease in the turbidity compared with the corresponding filtrates without paper pulp (Table 2, comparison examples UV-PUD 4 and 5). Also no flocculation of the paper particles was observed on addition of the radiation-curable aqueous polyurethane acrylate dispersions 4) and 5) to the paper pulp. The retention properties of comparison examples UV-PUD 4) and 5) were therefore evaluated as poor.

Determination of the Sizing of the Paper

The filtered paper as described above was dried at 50° C. for four hours and divided into three parts each of equal size. One part was not subjected to radiation curing, one part was cured with UV light and one part was cured with an electron beam. To evaluate the sizing of the papers, one drop of water was placed on the surface of the paper and the time taken for this to be absorbed by the paper was measured (Table 3). The time "without UV-PUD" serves as the reference, since this is non-sized paper, i.e. no radiation-curable aqueous polyurethane acrylate was added.

Re-Beatability of the Paper

A paper which has already been dried but not yet subjected to radiation curing and had been treated with the aqueous radiation-curable polyurethane acrylate dispersion 2) was beaten again in 1,000 ml of water in the mixer and the mixture was filtered and dried as described above. Renewed addition of aqueous radiation-curable polyurethane dispersion was omitted. To evaluate the sizing of the re-beaten paper, one drop of water was placed on the surface of the paper and the time taken for this to be absorbed by the paper was again measured (Table 3, UV-PUD 2, "re-beaten").

TABLE 3

| Evaluation of the sizing: times in which one drop is absorbed by the paper | | | | | | | |
|---|---|---|---|---|---|---|---|
| | Without UV-PUD[7] | Amount of polyurethane acrylate, based on the amount of paper (solid/solid) | UV-PUD 2) | UV-PUD 3) | UV-PUD 4) (comp.) | UV-PUD 5) (comp.) | UV-PUD 2) - re-beaten[8] |
| Without radiation curing | 27 sec | 2.5 wt. %[9] | 90 sec | 125 sec | 14 sec | 11 sec | 94 sec |
| | | 0.25 wt. %[11] | 9 sec | 6 sec | 20 sec | 8 sec | 10 sec |
| | | 0.025 wt. %[11] | 8 sec | 11 sec | 16 sec | 9 sec | 11 sec |
| UV curing[12] | 25 sec | 2.5 wt. %[9] | 104 sec | 134 sec | 13 sec | 16 sec | 121 sec |
| | | 0.25 wt. %[10] | 13 sec | 9 sec | 17 sec | 16 sec | 13 sec |
| | | 0.025 wt. %[11] | 7 sec | 14 sec | 16 sec | 12 sec | 10 sec |
| Electron beam curing[13] | 29 sec | 2.5 wt. %[9] | 402 sec | 291 sec | 17 sec | 34 sec | 390 sec |
| | | 0.25 wt. %[10] | 33 sec | 13 sec | 18 sec | 18 sec | 32 sec |
| | | 0.025 wt. %[11] | 23 sec | 11 sec | 23 sec | 14 sec | 20 sec |

comp. = comparison
[7]Paper which has been treated only with water instead of an aqueous radiation-curable polyurethane acrylate dispersion. The time value obtained is a reference value for the hydrophobicity/hydrophilicity of non-sized paper.
[8]Paper which has already been dried but not yet subjected to radiation curing and had been treated with the aqueous radiation-curable polyurethane dispersion 2) was beaten again in 1,000 ml of water in the mixer and the mixture was filtered over a filter and dried as described above. Renewed addition of radiation-curable aqueous polyurethane acrylate dispersion was omitted.
[9]1 g of an aqueous radiation-curable polyurethane acrylate dispersion (solids content 4 wt. %) was applied to 1.6 g of paper suspended in 1,000 ml of water.
[10]0.1 g of an aqueous radiation-curable polyurethane acrylate dispersion (solids content 4 wt. %) was applied to 1.6 g of paper suspended in 1,000 ml of water.
[11]0.01 g of a radiation-curable aqueous polyurethane acrylate dispersion (solids content 4 wt. %) was applied to 1.6 g of paper suspended in 1,000 ml of water.
[12]Belt speed = 5 m/min, mercury vapour lamp, radiant power = 80 W/cm
[13]Energy dose = 5 Mrad The UV-PUD 2) and 3) according to the invention (Table 3) at a content of 2.5 wt. % of polyurethane acrylate have the effect of hydrophobizing or sizing of the paper even without radiation curing. The effect is intensified significantly by the irradiation with UV light, but especially by the irradiation with an electron beam. The re-beaten paper which had been treated with the aqueous radiation-curable polyurethane acrylate dispersion 2) behaves similarly to the paper which has not been re-beaten in the sizing effect (Table 3). This shows that re-beating of dried paper is possible without problems.

The comparison examples UV-PUD 4) and 5) show a detectable hydrophobizing or sizing of the paper neither before nor after radiation curing.

Storage Stability of the Dispersions

In a further experiment, the dispersions 2) and 3) according to the invention were stored once at 23° C. for 6 months and once at 40° C. for 4 weeks. In all cases the dispersions were storage-stable and showed neither sedimentation nor coagulation. The dispersions 2) and 3) according to the invention have a non-aqueous content of 40 wt. %. From the logistics point of view, they are to be preferred over the AKD or ASA dispersions, and furthermore are very thinly liquid, i.e. they can be easily processed.

Testing of the Wet Strength

The wet strength of the papers was tested in accordance with the ASTM standard test methods D 829-97, D 828-97 and D 685-93.

Production of a Hand-Made Paper 80 g of paper pulp and an exactly calculated amount of polyurethane acrylate dispersion were added to 341 ml of water in order to obtain a certain amount of polyurethane acrylate, based on the paper (solid/solid). For example, for a paper provided with 1 wt. % of polyurethane acrylate, 0.125 g of a 40% strength polyurethane acrylate dispersion was added to 80 g of paper pulp with a solids content of 6.25 wt. % and 341 ml of water. This mixture was subjected to shearing forces at 600 revolutions/min for 10 min and then immediately brushed on to a paper mould. The upper side was covered with blotting paper and the mould was laid on a table with the blotting paper facing downwards, while a metal sieve was on the opposite side. The metal sieve was removed and further blotting paper was laid on the newly formed sheet of paper. The entire system was then pressed twice between two felt cloths in a roll press. The felt cloths and the blotting paper were removed, and the paper was dried at 121° C. for five minutes.

Radiation Curing of the Paper

The dried paper wet-strengthened with a radiation-curable dispersion was cured via electron beams at a fixed radiation dose (Table 4) or cured with UV rays (Table 5). In the production of the wet-strengthened papers which were cured with UV radiation, 2 wt. % of Irgacure 819 DW (bisacylphosphine oxide dispersed in water, BASF SE, Ludwigshafen, DE) were incorporated by means of shearing forces into the polyurethane acrylate dispersions used, before addition to the paper pulp, and the dried paper was cured under an iron- and a gallium-doped mercury lamp (lamp output in each case 80 W/cm) at a belt speed of 3 msec.

The papers which had been subjected to radiation curing were then stored at 23° C. and 45.6% relative atmospheric humidity for 24 h, before they were cut into strips of paper 25.4 mm×203.2 mm in size.

Wet Strength

The strips of paper were laid in water for two hours, pressed briefly between two sheets of blotting paper to remove excess water and measured for tensile strength in an Instron® 4444 (distance between the clamps 101.6 mm, drawing speed 25.4 mm/min).

The relative improvement in the tensile strength of sized paper, i.e. paper treated with radiation-curable aqueous polyurethane dispersion, compared with non-sized paper, i.e. paper which has not been treated with radiation-curable aqueous polyurethane dispersion, in the wet state was determined. The corresponding values achieved with electron beam curing are to be found in Table 4 and FIG. 1. The corresponding values achieved by UV curing are to be found in Table 5 and FIG. 2.

TABLE 4

Relative improvement in the tensile strength of sized paper compared with non-sized paper in the wet state for determination of the wet strength[14]; curing was via electron beams, radiation dose in parentheses.

| | Amount of polyurethane acrylate, based on the amount of paper (solid/solid) | | |
|---|---|---|---|
| | 0.5% wt. % | 1.0% wt. % | 2.0% wt. % |
| UV-PUD 2) - (3 Mrad)[15] | 110% | 178% | 241% |
| UV-PUD 4) (comparison) (3 Mrad) | 68% | 78% | 68% |
| UV-PUD 5) (comparison) (3 Mrad) | 82% | 73% | 80% |
| UV-PUD 2) - (7 Mrad)[15] | 163% | 233% | 378% |
| UV-PUD 4) (comparison) (7 Mrad) | 96% | 136% | 108% |
| UV-PUD 5) (comparison) (7 Mrad) | 95% | 99% | 111% |

[14]The values for the relative improvement in the tensile strength of the wet paper are based on the average values of in each case 6 measurements.
[15]The improvement in the tensile strength in the wet paper for papers provided with polyurethane acrylate dispersion 2) was between 2 and 16% over all the polyurethane acrylate contents before the radiation curing.

FIG. 1 is a graph showing the relative improvement in the tensile strength of sized paper compared with non-sized paper in the wet state for determination of the wet strength[16]; curing was via electron beams, radiation dose in parentheses.

[16]The values for the relative improvement in tensile strength of the wet paper are based on the average values of in each case 6 measurements.

TABLE 5

Relative improvement in the tensile strength of sized paper compared with non-sized paper in the wet state for determination of the wet strength[14]; curing was via UV rays.

| | Amount of polyurethane acrylate, based on the amount of paper (solid/solid) | | |
|---|---|---|---|
| | 0.5 wt. % | 1.0 wt. % | 3.0 wt. % |
| UV-PUD 2)[18] | 235% | 337% | 903% |
| UV-PUD 4) (comparison) | not determined | 145% | not determined |
| UV-PUD 5) (comparison) | not determined | 136% | not determined |

[17]The values for the relative improvement in the tensile strength of the wet paper are based on the average values of in each case 6 measurements.
[18]The improvement in the tensile strength in the wet paper for papers provided with polyurethane acrylate dispersion 2) was between 2 and 16% over all the polyurethane acrylate contents before the radiation curing.

The relative improvement in the tensile strength was not determined for the comparison examples UV-PUD 4) and 5) with a content of polyurethane acrylate, based on the amount of paper (solid/solid), of 0.5 wt. % and 3.0 wt. %, since the improvement in tensile strength was already significantly below that of Example 2) according to the invention at a content of 1 wt. % of polyurethane acrylate.

Figure 2:
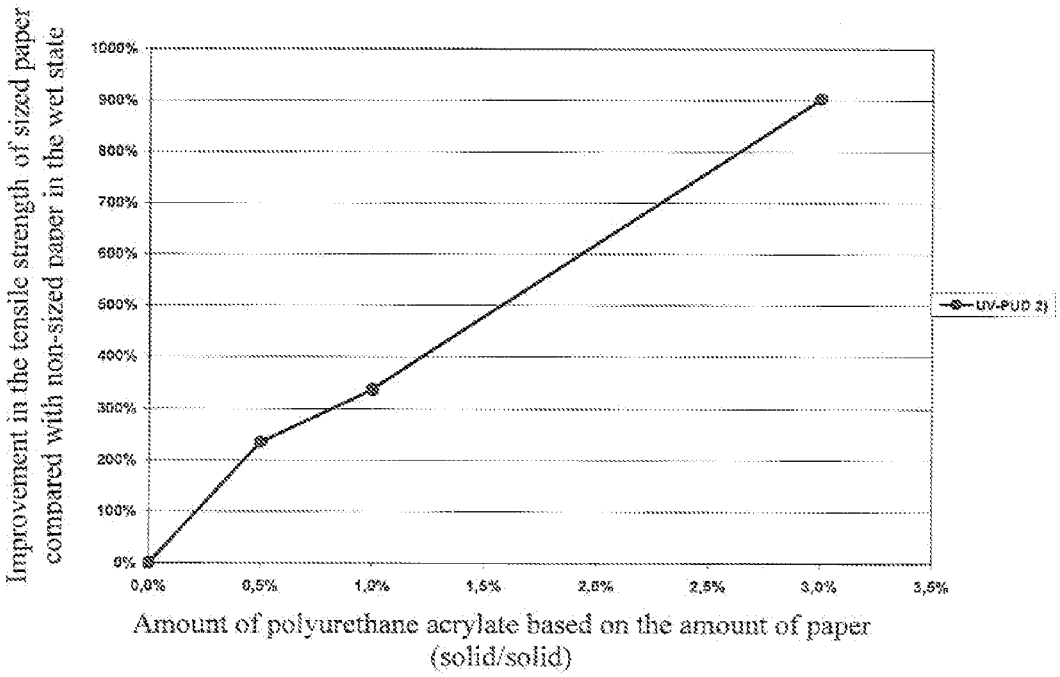
FIG. 2 is a graph showing the relative improvement in the tensile strength of sized paper compared with non-sized paper in the wet state for determination of the wet strength; curing was via UV rays

FIG. 2 is a graph showing the relative improvement in the tensile strength of size paper compared with non-sized paper in the wet state for determination of the wet strength[19]; curing was via UV rays.

[19]The values for the relative improvement in the tensile strength of the wet paper are based on the average values of in each case 6 measurements.

After electron beam curing, the polyurethane acrylate dispersion 2) employed in the process according to the invention leads to an ever better wet strength with increasing concentration of the polyurethane acrylate dispersion 2) in the paper (Table 4 and FIG. 1). It is likewise found that the wet strength increases with increasing radiation dose. In the process according to the invention, the wet strength can therefore be adjusted both via the concentration of the dispersions employed and via the radiation dose.

For the polyurethane acrylate dispersion 2), the improvement in the tensile strength in the wet paper before radiation curing was between 2 and 16% over all the polyurethane acrylate concentrations (footnote Table 4 and 5), which in practice means scarcely an improvement in the tensile strength. This shows that the wet strength is first effected by the radiation curing.

The comparison examples of the polyurethane acrylate dispersion 4) and 5) give throughout significantly smaller improvements in the tensile strength (that is to say a lower wet strength) in the paper. With the higher polyurethane acrylate concentration of Examples 4 and 5, the wet strength of the paper cannot be increased further.

The polyurethane acrylate dispersion 2) employed in the process according to the invention can also be cured via UV radiation (Table 5. FIG. 2). The wet strength can likewise be adjusted via the polyurethane acrylate concentration in the paper. Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. Process for the production of sized and/or wet-strength papers, paperboards and cardboards, the process comprising mixing suspended wood pulp and/or chemical pulp with an aqueous radiation-curable dispersion containing at least one polymer having cationic groups, sieving the mixture, pressing the mixture, thermally drying the mixture, and curing the mixture by subjecting the mixture to radiation wherein the mixture comprises 0.001 to 10 wt. % of the aqueous radiation curable dispersion, based on its non-aqueous content in relation to the solid content of the wood pulp and/or chemical pulp.

2. Process according to claim 1, wherein the aqueous radiation-curable dispersion contains radiation-curable unsaturated groups which are bonded to the polymer and/or are present in the form of radiation-curable monomers as so called reactive diluents (i).

3. Process according to claim 1, wherein the content of radiation-curable double bonds is between 0.3 and 6.0 mol/kg of non-aqueous constituents of the dispersion.

4. Process according to claim 1, wherein the radiation-curable dispersion has a weight-average molecular weight Mw of from 1,500 to 3,000,000 g/mol.

5. Process according to claim 1, wherein the average particle size of the dispersion is between 5 and 500 nm.

6. Process according to claim 1, wherein the dispersion has a density of cationic groups of between 0.05 and 10.0 mmol per 1 kg of the non-aqueous constituents of the dispersion.

7. Process according to claim 1, wherein the radiation-curable aqueous dispersion contains a polyurethane (meth) acrylate (ii) as the polymer.

8. Process according to claim 7, wherein the polyurethane (meth)acrylate (ii) is the reaction product of:

1) one or more compounds with at least one group which is reactive towards isocyanate and at least one unsaturated group which can undergo free radical polymerization,
2) optionally one or more monomeric and/or polymeric compounds which differ from 1),
3) one or more compounds with at least one group which is reactive towards isocyanate and additionally at least one cationic and/or potentially cationic group,
4) one or more organic polyisocyanates and
5) optionally compounds which differ from 1) to 3) and have at least one amine function.

9. Process according to claim 1, further comprising comminuting and re-suspending already dried paper waste which has not yet been cured and returning the comminuted and re-suspended dried paper waste to the process.

10. Process according to claim 1, wherein the radiation curing is carried out by an electron beam.

11. Papers, paperboards and cardboards produced by the process according to claim 1.

* * * * *